United States Patent [19]

Fineblum

[11] Patent Number: 4,679,890

[45] Date of Patent: Jul. 14, 1987

[54] CONNECTOR CONTACT TERMINAL

[75] Inventor: Solomon S. Fineblum, Randolph, N.J.

[73] Assignee: American Telephone and Telegraph Company, AT&T Bell Laboratories, Murray Hill, N.J.

[21] Appl. No.: 788,529

[22] Filed: Oct. 21, 1985

Related U.S. Application Data

[63] Continuation of Ser. No. 624,345, Jun. 25, 1984, abandoned.

[51] Int. Cl.[4] ..... H01R 3/00

[52] U.S. Cl. ..... 439/884; 439/894

[58] Field of Search ..... 339/278 R, 258 R

[56] References Cited

U.S. PATENT DOCUMENTS

| | | | |
|---|---|---|---|
| 2,434,123 | 1/1948 | Ridgers et al. | 339/278 R |
| 3,181,112 | 4/1965 | Bonhomme | 339/278 R |
| 3,281,760 | 10/1966 | Oshima et al. | 339/278 R |
| 3,416,126 | 12/1968 | Calevich et al. | 339/278 T |
| 3,697,934 | 10/1972 | Merry | 339/217 |
| 3,932,013 | 1/1976 | Yeager et al. | 339/19 |
| 4,299,432 | 11/1981 | Grau | 339/75 |

FOREIGN PATENT DOCUMENTS

| | | | |
|---|---|---|---|
| 2026786 | 2/1980 | United Kingdom | 339/278 T |

*Primary Examiner*—Gil Weidenfeld
*Assistant Examiner*—Paula A. Austin
*Attorney, Agent, or Firm*—Dwight A. Marshall

[57] ABSTRACT

A pin terminal for reducing the insertion force required to engage a connector with a mating contact terminal. The pin comprises a generally quadrilateral configured conducting member having one end formed with opposite curvilinear surfaces of different radii to generate a sequential deflection on blades of the contact terminal blades as the pin member is inserted into the contact terminal.

7 Claims, 3 Drawing Figures

CONNECTOR CONTACT TERMINAL

This application is a continuation of application Ser. No. 624,345, filed June 25, 1984, now abandoned.

TECHNICAL FIELD

This invention relates to contact terminal apparatus. In particular, it relates to a contact terminal for use with connector apparatus.

BACKGROUND ART

Connectors are widely used by the Electronics and Communication Industry to interconnect conductors and printed wiring circuit boards with backplane mounting apparatus used to interconnect the printed wiring circuit boards to form large complex electronic apparatus such as computers and telecommunication switching equipment. In the miniaturization of electronic apparatus, printed wiring circuit boards, hereinafter referred to as circuit boards, are being constructed with complex and high density circuit apparatus such as microprocessor chips that require a large number of conductor paths be established between the circuit board and backplane mounting apparatus. Typically, a microprocessor is assembled on a circuit board and is provided with a large number of contact terminals arranged in a high density row and column connector configuration. As the circuit board is inserted into backplane mounting apparatus the connector contacts engage corresponding high density male pin arrays of the backplane mounting apparatus and each connector contact terminal establishes an electrical connection between conductor paths of the circuit board and the male pins through the connector contact terminals.

A contact terminal characteristically has a pair of blades intended to receive a male pin with each blade having a bowed section directly opposed a bowed section of the other blade to engage the male pin. As the male pin is inserted in between the contact terminal blades the pin simultaneously engages both bowed sections and deflects the blades. A problem arises in that the total insertion force required to simultaneously deflect the contact terminal blades increases with the additional number of connector contact terminals required for high density circuit boards thereby causing damage to the backplane mounting pin arrays and increases the force required to insert and remove circuit boards from backplane mounting apparatus. In addition, the contact deflection force may well damage the miniature and fragile contact terminals and the male pins of the backplane mounting apparatus.

The foregoing and other problems are solved and a technical advance is achieved by a male pin terminal arranged to reduce the insertion force caused by the engagement of connector contact terminals with backplane mounting apparatus when circuit boards are inserted within the backplane mounting apparatus.

SUMMARY OF THE INVENTION

In the exemplarly embodiment of the invention a low insertion force male pin member is arranged to engage a female contact terminal having a pair of opposing contact blades each formed with an arcuate section bowed inwardly toward a central axis of the contact terminal. The pin member has one end with a curvilinear surface formed at a first radius and with another curvilinear surface opposite the one curvilinear surface formed at a second radius less than the first radius for generating a sequential deflection force on the opposing contact terminal blades as the pin member is inserted along the central axis between the blade arcuate sections.

In accordance with one feature of the invention, a low insertion force male pin for engaging a female contact terminal having a pair of blades each formed with an arcuate contact section bowed inwardly toward a central axis comprises a quadrilateral configured pin member formed of electrically conducting material having one end formed with one side thereof configured to have a curvilinear surface coined at a first radius and another side opposite the one side configured to have a curvilinear surface coined at a second radius less than the first radius. Insertion of the pin member into the contact terminal generates a sequential deflection force on the contact terminal blades as the pin member is inserted along the central axis of the contact terminal between the blade arcuate contact sections.

In accordance with another feature of the invention, a low insertion force connector system for use with a printed wiring circuit board and backplane apparatus comprises an insulated connector housing positioned on the printed wiring circuit board and having a plurality of electrical contact terminals located therein coupled with the circuit board printed wiring wherein each electrical contact terminal has a pair of opposed blades each formed with an arcuate contact section bowed inwardly toward a central axis of the contact terminal for interconnecting the printed wiring circuit board with the backplane apparatus. The low insertion force connector system further comprises a plurality of generally quadrilateral configured pin members formed of electrically conducting material each affixed in the backplane apparatus to extend perpendicular therefrom and having the free end thereof formed with one side coined to have a curvilinear surface of a first radius and another side opposite the one side to have another curvilinear surface of a second radius less than the first radius. Insertion of the pin members into the contact terminals generates a sequential deflection force of the contact blades as the pin members are inserted along the central axis between the blades arcuate contact sections and engaged therewith to electrically couple the printed wiring circuit board with the backplane apparatus.

In accordance with another feature of the invention a low insertion force pin for engaging a contact terminal having a pair of blades each formed with an arcuate contact section bowed inwardly toward a central axis comprises a quadrilateral configured pin member formed of electrically conducting material having one end formed with one side beveled at a first angle and a side opposite the one side beveled at a second angle less inclined than the first angle with respect to a center line of the pin member. Insertion of the pin member into the contact terminal generates a sequential deflection force on the contact terminal blades as the pin member is inserted along the central axis of the contact terminal between the blades arcuate contact sections.

DESCRIPTION OF THE DRAWING

The foregoing as well as other objects, features and advantages of the invention will be more apparent from a description of the drawing in which.

DESCRIPTION OF THE INVENTION

Figure 1:
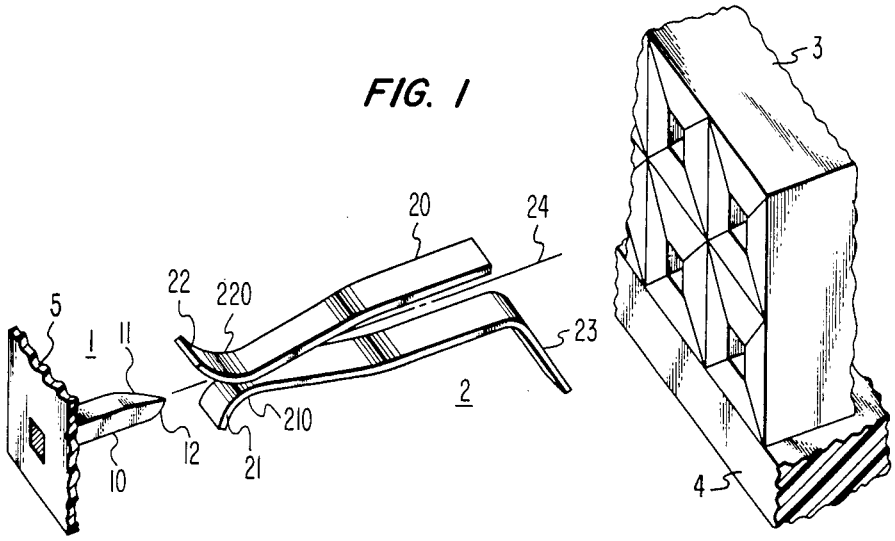
FIG. 1 is a perspective view showing the connector contact terminal apparatus of the instant invention.

Referring to FIG. 1 of the drawing, the low insertion force connector system set forth therein is intended in the present embodiment of the invention for use in interconnecting a printed wiring circuit board, hereinafter referred to as circuit board 4, with backplane apparatus 5. Insulated connector housing 3, positioned on circuit board 4 may be a multirow and column type of connector housing wherein a plurality of contact terminals 2 are located therein and each connected by contact tail 23 with the printed wiring circuitry of circuit board 4. When circuit board 4 is inserted into equipment mounting apparatus each contact terminal 2 engages a pin member 1 affixed to backplane apparatus 5 so that an electrical conducting path is established from the printed wiring circuitry of circuit board 4 through contact terminal 2 and pin member 1 with backplane apparatus 5.

Each contact terminal 2 comprises a generally rectangular base section 20 formed from an electrical conducting material such as a beryllium copper alloy. A pair of separated blades 21, 22 extend horizontally outward from one edge of base section 20 and a third blade, herein referred to as contact tail 23, extends horizontally outward from another edge of base section 20 opposite one of the pair of blades 21, 22. Base member 20 is formed into a generally U-shaped configuration around a central axis 24 with each of the pair of blades 21, 22 positioned along central axis 24. Opposed blades 21 and 22 each have an arcuate contact section 210 and 220, respectively, formed inwardly toward central axis 24 to engage male pin member 1 as pin member 1 is inserted into contact terminal 2 along central axis 24.

Pin member 1 is a generally quadrilateral configured pin member formed from a firm electrical conducting material such as a nickel copper alloy. As set forth in FIG. 2 of the drawing, one end 10 of pin member 1 is formed to have a curvilinear surface 11 with a radius of R1. Another curvilinear surface 12 having a radius of R2 which is less than radius R1 is formed directly opposite of curvilinear surface 11 on end 10 of pin member 1. Although curvilinear surfaces 11 and 10 are shown in the drawing as convex surfaces it is to be understood that both or either could have a concave configuration. Typically, pin member 1 has a cross-sectional area of 25 square mil with curvilinear surface 11 having a radius R1 in the range of 160 to 240 mil and curvilinear surface 12 having a radius R2 in the range of 40 to 75 mil. Although pin member 1 has a quadrilateral configuration in the present embodiment of the invention it is to be understood that pin member 1 can be a round pin member having curvilinear surface 11 formed opposite curvilinear surface 12 at one end thereof. In addition, pin member 1 may have end 10 formed with surface 11 beveled at a first angle and surface 12 beveled at a second angle less inclined than the first angle with respect to center line 13.

Pin member 1 is usually affixed to backplane apparatus 5 of circuit board mounting equipment by inserting a compliant section of pin member 1 into a hole of backplane apparatus 5 or by soldering pin member 1 within the backplane hole such that pin member 1 extends perpendicularly outward with free end 10 intended to engage contact terminal 2.

Figure 2:
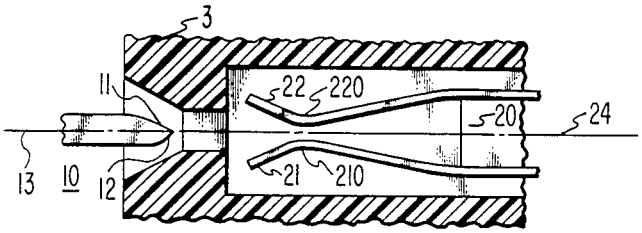
FIG. 2 is a cross-sectional view of the contact blades of the connector contact terminal and pin member embodying the principles of the instant invention, and FIG. 3 sets forth a graph illustrating insertion force vs. the pin insertion position during engagement of the pin member and connector contact terminal apparatus set forth in FIGS. 1 and 2.

Referring to FIG. 2 of the drawing, the insertion of end 10 of pin member 1 along central axis 24 into contact terminal 2 results in engagement of pin member end 10 with contact blade arcuate sections 210 and 220. As the contact blade arcuate section 210 engages curvilinear section 12 and is deflected thereby an insertion force is generated as shown on the graph of FIG. 3 of the drawing by the dotted line 12. The insertion force rapidly increases as arcuate surface 210 of contact blade 21 moves upward along curvilinear surface 12 of pin member 1 until the point of tangency is reached. After the point of tangency has been reached, the insertion force represented by dotted line 12 decreases as arcuate surface 210 moves downward along pin curvilnear surface 12 until the main body of the pin is reached at which time the insertion force declines to a steady state value.

Figure 3:
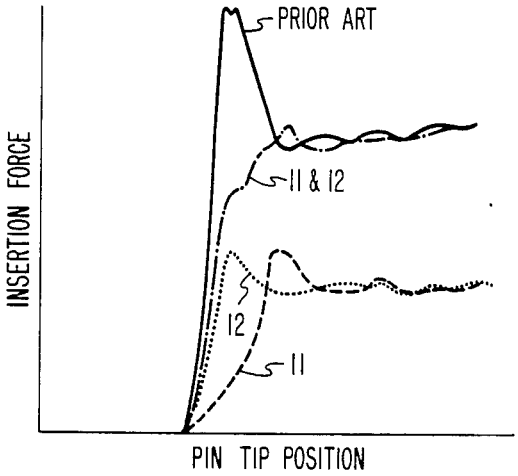

During the insertion sequence arcuate section 220 of contact blade 22 moves along curvilinear surface 11 of pin member 1. Since the radius R1 is greater than radius R2 of curvilinear surface 12 the point of tangency of curvilinear surface 11 with arcuate section 220 occurs at a later time than the point of tangency of curvilinear section 12 with arcuate section 210. Thus, the plot of the insertion force verses the pin tip position for curvilinear section 11 illustrates that the insertion force shown as dashed line 11 on FIG. 3 of the drawing, increases less rapidly and peaks at a later pin position within contact terminal 2 than does insertion force 12 for the pin curvilinear surface 12. The combination of insertion forces 11 and 12 shown as broken line 11 and 12 on the graph of FIG. 3 illustrates that the total insertion forces for a pin member having opposing curvilinear surfaces 11, 12 of different radii at the end thereof is less than the insertion force of a pin member having curvilinear surfaces with equal radii.

In one embodiment of the invention pin member 1 and contact terminal 2, FIG. 1, may be used as a low insertion force connector system with circuit board 4 and backplane apparatus 5 of circuit board mounting equipment. An insulated connector housing 3 intended to be positioned on circuit board 4 has a plurality of electrical contact terminals 2 located in a row and column configuration therein with a contact tail 23 of each contact terminal connected to corresponding printed wiring circuitry of circuit board 4. A plurality of pin members 1 are affixed to backplane apparatus 5 of circuit board mounting equipment such that free end 10 having opposing curvilinear surfaces 11 and 12 extend perpendicularly outward therefrom. When circuit board 4, having insulated connector housing 3 positioned thereon, is inserted into the circuit board mounting equipment, pin members 1 of backplane mounting apparatus 5 engage contact terminal blades 21, 22 to establish electrical connections between backplane apparatus 5 and the printed wiring circuitry of circuit board 4. The curvilinear design of surfaces 11 and 12 of pin member 1 have a low insertion force characteristic that enable a large number of pin members and contact terminals to be utilized in a circuit board connector system.

SUMMARY

It is obvious from the foregoing that the facility, economy and efficiency of contact terminal apparatus may be substantially enhanced by a pin member arranged to decrease the insertion force required to engage a mating conductor with a contact terminal. It is further obvious that a pin member having first and second curvilinear surfaces formed with different radii at the end thereof to generate a sequential deflection force when the male pin member is inserted between opposing blades of a female contact terminal facilitates the use of high density and miniaturized connector apparatus.

What is claimed is:

1. A male pin for engaging a pair of opposing female blades each formed with an arcuate section bowed inwardly toward a central axis to engage the pin comprising:

a pin member with an end thereof having a pair of curvilinear surfaces each corresponding with one of said female blades for engagement therewith with one curvilinear surface formed to extend from the central axis at the pin end at a first radius and the other curvilinear surface opposite said one curvilinear surface formed to extend from the pin end central axis at a second radius less than said first radius for generating a sequential deflection force on the blades as said pin member is inserted along the central axis between the pair of female blade arcuate sections.

2. A pin for engaging a pair of opposing contact blades each having an arcuate contact section bowed inwardly toward a central axis to engage the pin comprising:

a pin member formed of electrically conducting material with one end thereof having a pair of curvilinear surfaces each corresponding with one of said contact blades for engagement therewith with one curvilinear surface coined to extend from the central axis at the pin end at a first radius and the other curvilinear surface opposite said one curvilinear surface coined to extend from the pin end central axis at a second radius less than said first radius for generating a sequential deflection force on the opposing contact blades as said pin member is inserted along the central axis between the pair of blade arcuate contact sections.

3. A low insertion force pin for engaging a female contact terminal having a pair of blades each formed with an arcuate contact section bowed inwardly toward a central axis to engage the pin comprising:

a generally quadrilateral configured pin member formed of electrically conducting material having one end formed with a pair of curvilinear surfaces each corresponding with one of said female contact terminal blades for engagement therewith with one side thereof configured to have a curvilinear surface coined to extend from the central axis at the pin end at a first radius and the other side opposite said one side configured to have a curvilinear surface coined to extend from the pin end central axis at a second radius less than said first radius for generating a sequential deflection force on the female contact terminal blades as said pin member is inserted along said central axis between the pair of said female contact terminal blade arcuate contact sections.

4. A low insertion force connector system for use with a printed wiring circuit board and backplane apparatus comprising:

an insulated connector housing positioned on the printed wiring circuit board and having a plurality of electrical contact terminals located therein coupled with the circuit board printed wiring wherein each electrical contact terminal has a pair of opposed blades each formed with an arcuate contact section bowed inwardly toward a central axis of the contact terminal for interconnecting the printed wiring circuit board with the backplane apparatus, and a plurality of generally quadrilateral configured pin members formed of electrically conducting material each affixed in the backplane apoaratus to extend perpendicular therefrom and having one end thereof formed with a pair of curvilinear surfaces each corresponding with one of said contact terminal blades for engagement with one side coined to have a curvilinear surface extending from a central axis of said pin member end at a first radius and the other side opposite said one side to have another curvilinear surface extending from the pin member end central axis at a second radius less than said first radius for generating a sequential deflection force on said contact terminal blades as said pin member is inserted along said central axis between the pair of said blade arcuate contact sections and engaged therewith to electrically couple the printed wiring circuit board with the backplane apparatus.

5. The low insertion force connector system set forth in claim 4 wherein said quadrilateral configured pin members each have a cross-sectional area of 25 square mil, wherein said first radius of said one side curvilinear surface is of the range of 160 to 240 mil, and wherein said second radius of said opposite side curvilinear surface is of the range of 40 to 75 mil.

6. A low insertion force connector pin for engaging a contact terminal having a pair of blades each formed with an arcuate contact section bowed inwardly toward a central axis to engage the pin comprising a generally quadrilateral configured pin member formed of electrically conducting material having one end formed with a pair of beveled sides each corresponding with one of said contact terminal blades for engagement therewith with one side beveled to extend from a center line at the pin member end at a first angle and having the other side opposite said one side beveled to extend from the pin member end center line at a second angle less inclined than said first angle with respect to the center line of said pin member for generating a sequential deflection force on the contact terminal blades as said pin member is inserted along said central axis between the pair of said blade arcuate contact sections.

7. A low insertion force connector system for interconnecting conductors comprising:

a contact terminal having a U-shaped base section with a pair of opposing female blades extending outward therefrom with each female blade formed to have an arcuate contact section bowed inwardly toward a central axis of the contact terminal for terminating one of the conductors, and a pin member for terminating another of the conductors and having one end thereof formed with a pair of opposing curvilinear surfaces each corresponding with one of said female blades for engagement therewith with one curvilinear surface formed to extend from a central axis of the pin member at the pin end at a first radius and the other curvilinear surface opposite said one curvilinear surface formed to extend from the pin end central axis at a second radius less than said first radius for generating a sequential deflection force on the female blades as said pin member is inserted along the contact terminal central axis into the contact terminal between the pair of female blade arcuate sections.

* * * * *